United States Patent [19]

Saran et al.

[11] 4,372,868

[45] Feb. 8, 1983

[54] PROCESS FOR THE PREPARATION OF A STABLE, READILY SOLUBLE GRANULATE WITH A CONTENT OF BLEACH ACTIVATORS

[75] Inventors: Herbert Saran; Martin Witthaus, both of Düsseldorf; Eduard Smulders, Hilden; Karl Schwadtke, Leverkusen, all of Fed. Rep. of Germany

[73] Assignee: Henkel Kommanditgesellschaft auf Aktien, Düsseldorf-Holthausen, Fed. Rep. of Germany

[21] Appl. No.: 246,097

[22] Filed: Mar. 20, 1981

[30] Foreign Application Priority Data

Mar. 28, 1980 [DE] Fed. Rep. of Germany ..... 3011998

[51] Int. Cl.[3] ..... C11D 3/30; C11D 3/395; C11D 11/00; C11D 17/06

[52] U.S. Cl. ..... 252/102; 252/95; 252/99; 252/174; 252/174.13; 252/186.41; 264/117; 264/122; 427/212

[58] Field of Search ..... 252/98, 99, 102, 90, 252/174, 174.13, 186, 94; 264/117, 122; 427/212

[56] References Cited

U.S. PATENT DOCUMENTS 3,163,606 12/1964 Viveen et al. ..... 252/99
3,789,002 1/1974 Weber et al. ..... 252/99
3,925,234 12/1975 Hachmann et al. ..... 252/102 X
4,009,113 2/1977 Green et al. ..... 252/102 X

*Primary Examiner*—Dennis L. Albrecht
*Attorney, Agent, or Firm*—Hammond & Littell, Weissenberger and Muserlian

[57] ABSTRACT

This invention relates to a process for preparing bleach activator granulates comprising from about 90 to 98 percent by weight of bleach activator and from about 10 to 2 percent by weight of granulating adjuvant, based on the weight of the anhydrous components, which comprises the steps of:

(a) mixing powdered bleach activator which has a mean particle size of from about 0.01 to 0.8 mm with from about 50 to 100 percent by weight of the total granulating adjuvant to be used, which granulating adjuvant comprises a water-soluble cellulose ether, starch, or starch ether in the form of a free-flowing powder having a mean particle size of from about 0.01 to 0.8 mm;

(b) moistening the mixture from step (a) with water or an aqueous solution containing the remainder of the granulating adjuvant in a solution of from about 0.1 to 10 percent by weight, based on the weight of the total solution;

(c) granulating the moist mixture from step (b); and (d) drying the moist granulate from step (c) until the moisture content is less than 2 percent by weight, preferably less than 1 percent by weight. Additionally, during steps (a) or (b), a polysiloxane defoaming agent can be added.

30 Claims, No Drawings

PROCESS FOR THE PREPARATION OF A STABLE, READILY SOLUBLE GRANULATE WITH A CONTENT OF BLEACH ACTIVATORS

FIELD OF THE INVENTION

This invention relates to a process for preparing granulates containing bleach activators. More particularly, this invention relates to a process for preparing stable, readily soluble granulates containing N-acylated amines, amides, diketopiperazines, or glycolurils as bleach activators.

BACKGROUND OF THE INVENTION

Bleach activators are compounds that react in aqueous solutions containing hydrogen peroxide or perhydrates, with the formation of peracids that have a bleaching effect. Especially active bleach activators include N-acylated amines, amides, glycolurils that are known from, for example, U.S. Pat. Nos. 3,163,606, 3,177,148, 3,775,332, 3,812,247, and 3,715,184, all of which are incorporated herein by reference. In U.S. Pat. No. 3,163,606, there is a suggestion that these bleach activators should be provided with a water-soluble coating, which coating may consist of carboxymethyl cellulose, for example, prior to their further application, particularly before use in washing agents and bleaches. This coating agent may be sprayed on the activator in finely powdered form dissolved in water, after which the coated material is dried. It is recommended that the activator be granulated before coating, but there are no indications given as to the method and granulating adjuvants to be used.

When the procedures disclosed in U.S. Pat. No. 3,163,606 are implemented, considerable problems are encountered when a bleach activator such as, for example, tetraacetylethylenediamine, is sprayed with an aqueous carboxymethyl cellulose solution in a granulator. This is so because aqueous solutions with a content of more than 5 percent by weight of carboxymethyl cellulose no longer can be worked in technical granulating processes due to their high viscosity and gel-like consistency. Consequently, very large amounts of the relatively very dilute cellulose ether solutions must be used to produce a sufficiently strong coating layer on the activator particles.

When an amount of 18 percent by weight of carboxymethyl cellulose is to be applied to the bleach activator, as stated in Example 10 of U.S. Pat. No. 3,163,606, and when it is assumed that a 5 percent solution is used that still is workable with respect to its high viscosity, then 360 percent by weight (based on the amount of activator) of a 5 percent cellulose ether solution would be required for this purpose. However, it can be demonstrated that lumpy to pulpy masses instead of suitable granulates are formed when more than 20 to 30 percent by weight of such a solution is used. This is the reason for the recommendation in Column 3 of U.S. Pat. No. 3,163,606 that alcoholic solutions of carboxymethyl cellulose be used. Unfortunately, the use of such solutions necessitates the installation of expensive protection against explosions and leads to high costs for the recovery of the solvent, and such a procedure is unsuitable for commercial purposes. The same problems are encountered when the cellulose ether solution is replaced by the fatty acids, fatty acid alkanolamides, fatty alcohols, or Carbowaxes also suggested in U.S. Pat. No. 3,163,606, dissolved in organic solvents, as coating material. An added complication is that such coating materials dissolve either not at all or only very slowly in cold bleach solutions and the desired cold-bleaching effect thus is suppressed.

U.S. Pat. No. 3,789,002 discloses a process for the preparation of coated, granulated bleach activators in which the activator first is mixed dry with a substance suitable for coating or granulation and, in a second step, is then sprayed and granulated with water or granulating adjuvants dissolved in water or film-forming agents. The substances proposed for the preparation of the dry premixes are either water-soluble builder salts normally used in washing agents, such as phosphates, polyphosphates, carbonates, and silicates of alkali metals that bind water of crystallization, or fillers that are insoluble in water, such as silicic acid, magnesium silicate, or magnesium oxide. The same water-soluble salts that bind water of crystallization also may be used as granulating adjuvants, or the dry premixes may be sprayed with an aqueous solution of film-forming substances such as cellulose derivatives, or of other water-soluble polymers of natural or synthetic origin, and granulated simultaneously. However, this method is suitable only for the preparation of granulates with a relatively low content of bleach activators, i.e. with one of less than 50 percent by weight. Consequently, the granulates can be used only in those areas where the high content of additives does not interfere.

Thus, there has been a need to develop a process for the preparation of free-flowing, uniformly coated, and consequently very stable bleach activator granulates that have a considerably high content of active substance, for example, 90 percent by weight and more.

OBJECTS OF THE INVENTION

It is an object of the invention to provide washing and bleaching compositions containing bleach activators.

It is also an object of the invention to provide bleach activators in coated form to enhance the activity and stability of said bleach activators.

It is a further object of the invention to provide a process for preparing stable, water-soluble granulates of bleach activators.

These and other objects of the invention will become more apparent in the discussion below.

DETAILED DESCRIPTION OF THE INVENTION

Applicants have developed a process for preparing bleach activator granulates which satifies the criteria set forth above. According to the process, a stable granulate containing bleach activators is prepared by dry mixing a powdered bleach activator selected from the group consisting of the N-acylated amines, amides, diketopiperazines, and glycolurils with a powdered granulating adjuvant; wetting the dry premix with an aqueous solution of the granulating adjuvant; and granulating the moist mix in a mixing and granulating machine. A granulate containing from about 90 to 98 percent by weight of bleach activator and from about 10 to 2 percent by weight of granulating adjuvant, based on the weight of the anhydrous components, is prepared by the steps of:

(a) mixing the powdered bleach activator, which has a mean particle size of from about 0.01 to 0.8 mm, with from about 50 to 100 percent by weight of the total granulating adjuvant to be used, which granulating adjuvant comprises a water-soluble cellulose ether, starch, or starch ether in the form of a free-flowing powder having a mean particle size of from about 0.01 to 0.8 mm;

(b) moistening the mixture from step (a) with water or an aqueous solution containing the remainder of the granulating adjuvant in a solution of from about 0.1 to 10 percent by weight, based on the weight of the total solution;

(c) granulating the moist mixture from step (b); and (d) drying the moist granulate from step (c) until the moisture content is less than 2 percent by weight, preferably less than 1 percent by weight.

A "mean particle size of from about 0.01 to 0.8 mm" is meant to be that in which more than 50 percent by weight, preferably at least 80 percent by weight, of the particles have a particle size of from about 0.01 to 0.8 mm, not more than 25 percent by weight, preferably not more than 10 percent by weight, have a particle size of from about 0.8 to at most 1.6 mm, and not more than 25 percent by weight, preferably not more than 10 percent by weight, have a particle size of less than about 0.01 mm. The particle size of the small particles is not limited with regard to how small they may be, and particles as fine as dust may be present as well. That such dust-like particles, which usually are present in technical-grade, unsized powder products with a broad particle spectrum, may be included for the application of the powders prepared represents an additional advantage of the process of the invention.

Suitable bleach activators include the known N-acylated amines, diamines, amides, and glycolurils, which are disclosed in the patents mentioned above. Specific suitable compounds include, for example, tetraacetylmethylenediamine, tetraacetylethylenediamine, diacetylaniline, diacetyl-p-toluidine, 1,3-diacetyl-5,5-dimethylhydantoin tetraacetylglycoluril, tetrapropionylglycoluril, 1,4-diacetyl-2,-5-diketopiperazine, and 1,4-diacetyl-3,6-dimethyl-2,5-diketopiperazine. The use of tetraacetylethylenediamine as bleach activator is preferred.

In step (a), the powdered bleach activator is mixed with part of the granulating adjuvant, which is also in powder form. The proportion of granulating adjuvant to be added in this step is from about 50 to 100, preferably from about 80 to 95, percent by weight of the total amount of granulating adjuvant to be used. Consequently, the total amount or only part of the granulating adjuvant may be added in the first mixing step. The latter variation, in which only part of the granulating adjuvant is added dry in step (a) and the rest is mixed in as solution in the step (b), is preferred.

The mean particle size of the granulating adjuvant is from about 0.01 to 0.8 mm, according to the above definition. It is advantageous to keep the particle size of the powdered granulating adjuvant equal to or smaller than the particle size of the bleach activator. For example, with a mean particle size of from about 0.01 to 0.8 mm for the bleach activator, an advantageous particle size for the granulating adjuvant is from about 0.01 to 0.4 mm, with the proportion of particles with a particle size of from about 0.4 to 1.6 mm not to exceed 25 percent by weight and especially not 10 percent by weight.

The granulating adjuvant consists of a water-soluble cellulose, ether, water-soluble starch, or a water-soluble starch ether. Examples of cellulose ethers include methyl cellulose, ethyl cellulose, hydroxyethyl cellulose, methylhydroxyethyl cellulose, methylhydroxypropyl cellulose, carboxymethyl cellulose (as the sodium salt) and methylcarboxymethyl cellulose (Na-salt). Depolymerized starch is an example of a suitable starch. Suitable starch ethers include, for example, carboxymethyl starch, hydroxyethyl starch, and methyl starch. Sodium carboxymethyl cellulose proved to be particularly suitable.

The two powdered components, that is, the bleach activator and the granulating adjuvant, may be mixed in conventional batch or continuous mixers that usually are equipped with rotating mixing parts. Dependent upon the effectiveness of the mixers, the mixing times are generally from about 30 seconds to 5 minutes for a homogeneous mixture.

If the cellulose and starch ethers used in the mixture do not develop a certain swelling effect of their own, small amounts of known swelling powders normally used in the tableting industry also may be added for the acceleration of the solution process during subsequent use in the bleaching bath. Suitable swelling agents include, for example, partially broken down starch, starch ether, polyvinylpyrrolidone, formaldehyde casein, and magnesium aluminosilicates that will swell (Veegum). The content of such swelling powders can amount to from about 0 to 2 percent by weight of the anhydrous granulate.

The dry powder mixture is moistened with the granulating liquid, that is, water or an aqueous solution of the still remaining granulating adjuvant, and the moist mixture is granulated. If the mixing machine used in the first mixing step, step (a), is suitable also for a granulating process, the materials to be mixed can be left in it for the granulating process. However, it is also advantageous to transfer the mixture to a granulator after the completion of the mixing process, for example, into a granulating drum or to a rotating granulating plate, and to perform a complete granulating process there. With this type of method, part of the granulating liquid is advantageously added to the mixer already towards the end of step (a) to moisten the mixture and to inhibit the formation of dust. For example, from about 5 to 70 percent of the granulating liquid is added toward the end of step (a) and from about 95 to 30 percent of the liquid is added during step (b).

Unless water alone is used as granulating liquid, the granulating adjuvant added to step (b) is preferably added in the form of an aqueous solution of from about 0.5 to 5 percent by weight. More concentrated solutions containing up to about 10 percent by weight of granulating adjuvant can be recommended only when they have an adequately low viscosity. When sodium carboxymethyl cellulose is added in a form normally used in washing agents, the concentration is preferably not higher than about 4 percent by weight.

The granulating liquid is applied in an amount adequate to produce a moist granulate that still does not tend to stick together. This is achieved when the water content of the moist granulate is from about 10 to 35, preferably from about 15 to 25, percent by weight. Powder mixtures with a small particle spectrum and a higher content of powdered granulating adjuvant can absorb larger quantities of granulating liquid than less finely granulated mixtures with smaller amounts of granulating adjuvant.

A dye or a white pigment for coloring or for covering the inherent color of the starting materials may be added to the dry powder mixture or to the granulating liquid, if desired. Generally, from about 0.01 to 0.1 percent by weight of dye or color pigment, based on the weight of the finished product, is sufficient for this purpose.

The moisture content of the mixture is subsequently decreased at less than 2 percent by weight, preferably at less than 1 percent by weight. The removal of excess water may be effected by drying through input of heat, whereby the temperature of the granulate preferably not exceeding 100° C. and remaining below the melting temperature of the bleach activator. Suitable drying apparatuses include dryers that do not alter the granular structure of the product to its detriment, such as e.g., hurdle, vacuum, or fluidized bed dryers. The dried granulates should contain less than 2, preferably less than 1 percent by weight of water.

The removal of the excess moisture may be also effected by the mixing of the moist granulates with water removing salts which are essentially anhydrous or of low water content and which crystallize by taking up water of crystallization. In as much as the subsequent use of the granulate is in detergent compositions or for washing purposes, a certain content of such type of salts and which are usually used in detergent compositions or in washing processes, does not interfere. Typical examples for this type of salts are sodium tripolyphosphate, sodium sulfate, sodium carbonate, sodium silicate, and the cation-exchanging waterinsoluble sodium aluminosilicates containing reduced amounts of water of hydration, as well as mixtures of these salts. The amounts of these salts to be used depends on their water binding capacity and on the water content of the moist granulate. In the case of the anhydrous sodium tripolyphosphate which is preferably used, the mixing ratio of tripolyphosphate and moist granulate is, e.g., between 1:3 and 1:1, especially between 1:2 and 1:1. The mixing may be done in usual mixers and granulating devices. The mixing apparatuses used for the production of the moist granulates may directly be used for this purpose. This allows a simplified, especially energy saving processing which avoids the drying step.

During the granulating process to produce granulates for the purpose of detergent compositions and washing processes respectively, it is further possible to admix such compounds that are usually added to detergent compositions in very small amounts and in a separate mixing process.

These are additives such as foam inhibitors and perfumes which are usually inactivated or lost during the usual manufacture of detergent compositions, especially by the method of hot atomization. Useful foam inhibitors are the usual well known defoaming agents such as polysiloxanes and their mixtures with micro-sized silica, e.g. polydimethylsiloxanes with a content of about 1 to 10 percent by weight of micro-sized silica. The content of these defoaming agents in the resulting granulate may be in the region of 1 to 5 percent by weight, preferably 2 to 4 percent by weight. The admixing of the defoaming agent may take place already in the first mixing step (step a). The defoaming agent may also be dispersed in the granulating liquid, however, in order to avoid separation, the granulating liquid should in this case contain only parts of the granulating adjuvant.

The granulates produced in the manner described have a favorable particle spectrum. Coarser and finer particles that may be present can be screened out and, after grinding the coarse particles, returned into the process. The granulates flow well, do not stick, and are very stable with respect to the complete coating of the activator particles. Especially advantageous is their high content, that is, 90 or more percent by weight, of active substance. They can be used to advantage in washing, bleaching, oxidizing, and disinfecting agents, and they retain their good properties also when mixed with the active substances contained in these agents. More particularly, the granulates prepared according to the invention are useful in activating aqueous solutions of percompounds selected from the group consisting of hydrogen peroxide and water-soluble peroxyhydrates containing from 5 to 500 mg of active oxygen per liter of solution.

The following examples are intended to illustrate the invention and should not be construed as limiting the invention thereto.

EXAMPLES

EXAMPLE 1

Tetraacetylethylenediamine with a mean particle size of from about 0.01 to 0.8 mm was used as bleach activator. The proportion of particles of from 0.8 to 1.6 mm amounted to 5 percent by weight, and the content below 0.01 mm was 10 percent by weight.

An amount of 2.817 kg of the powdered bleach activator and 0.15 kg of sodium carboxymethyl cellulose were mixed for 1 minute in a horizontally rotating mixer equipped with mixing and crushing tools attached to a shaft rotating at high speed. The particle size of 94 percent by weight of the carboxymethyl cellulose was from 0.01 to 0.8 mm, the particle size of 1 percent by weight was from 0.8 to 1.6 mm, and the particle size of 5 percent by weight was below 0.01 mm. The amount of carboxymethyl cellulose added in the first mixing step was 83.3 percent of the total amount.

Then, a solution of 30 gm of sodium carboxymethyl cellulose (16.7% of the total amount) and 2.25 gm of a dye (Pigmosol blue) in 1.18 kg water was introduced into the agitating mixture over a period of 5 minutes through the rotating, hollow drive shaft of the mixer, and the resulting mixture was then granulated for one more minute. After drying to a moisture content of less than 1 percent by weight, the fine and coarse grains with a particle size of less than 0.5 mm or more than 1.5 mm were separated by screening. The granulate with a particle range between 0.5 and 1.5 mm amounted to 75 percent by weight. The granulate was homogeneous, flowed well, was stable in storage, and had the following composition (calculated as anhydrous substance):

| Component | Percent by weight |
|---|---|
| Tetraacetylethylenediamine | 93.95 |
| Sodium carboxymethyl cellulose | 5.98 |
| Dye | 0.07 |
| | 100.00 |

EXAMPLE 2

Forty-two kilograms of the powdered tetraacetylethylenediamine used in Example 1 and 2.24 kg of sodium carboxymethyl cellulose having the particle size given in Example 1 (88.2 percent of the total amount used) were mixed for 2 minutes in a drum mixer equipped with rotating mixing elements (LÖDIGE mixer) and then sprayed with a solution of 170.4 gm of sodium carboxymethyl cellulose in 5.51 kg of water (3 percent by weight ) with continued mixing, to bind the dust-like particles. The mixture was transferred into a continuous mixing granulator (output 800 kg/hr). The discharging chute of this mixer was connected to the feeder via conveyor belts, so that the product could be circulated. An amount of 4.3 kg of a 3 percent solution of sodium carboxymethyl cellulose (corresponding to 129 gm) was added through the rotating shaft of the granulating mixer over a period of 9 minutes. Granulating was continued for another minute, and the product was then removed from the cycle.

The main part of the granulate was dried in a vacuum drying oven at 50 torr over a period of 24 hours to a moisture content of less than 1 percent by weight. Three kilograms of the moist granulate were dried to the same degree of dryness in a fluidized bed dryer with the air at an intake temperature of 57° C., over a period of 10 minutes. The granulate with a particle size of 0.5 to 1.5 mm amounted to 65 percent by weight in both cases. Coarse and fine particles were removed by screening and added to the next granulating process, after milling the coarse particles.

| Component | Percent by Weight |
|---|---|
| Tetraacetylethylenediamine | 94.3 |
| Sodium carboxymethyl cellulose | 5.7 |
| | 100.0 |

EXAMPLE 3

Ninety-five parts by weight of the tetraacetylethylenediamine used in Example 1 and 5 parts by weight of sodium carboxymethyl cellulose were mixed in a continuous mixer. In the last third of the mixer, 10 parts by weight of a solution of 0.34 parts by weight of sodium carboxymethyl cellulose in 11 parts by weight water (3 percent solution) were sprayed continuously through jets onto the mixture, to bind the dust. The moistened mixture was moved into a continuously operating granulator (cf. Example 2), where it was sprayed with 10 parts by weight of a solution of 96.33 percent by weight water, 3 percent by weight sodium carboxymethyl cellulose, and 0.67 percent by weight dye (cf. Example 1) and granulated. The granulated mixture was transferred from the granulator to a conveyor belt, which removed a 70 percent by weight partial stream and returned a 30 percent by weight partial stream to the granulator. The finished granulate had the following composition (calculated as anhydrous substance) after drying:

| Component | Percent by Weight |
|---|---|
| Tetraacetylethylenediamine | 94.37 |
| Sodium carboxymethyl cellulose | 5.56 |
| Dye | 0.07 |
| | 100.00 |

Sixty-seven percent by weight of the granulate had a particle spectrum between 0.5 and 1.5 mm. The fine particles removed by screening after drying as well as the milled coarse particles were returned continuously into the granulator.

EXAMPLE 4

According to the methods of production as described in Example 1 91.45 parts by weight of tetraacetylethylenediamine were mixed with 3.048 parts by weight of a polysiloxane defoaming agent (consisting of 93 percent by weight of polydimethylsiloxane and 7 percent by weight of silanated micro-sized silica), and 4.8 parts by weight of sodium carboxymethyl cellulose. The mixing time was 2 minutes.

The particle size range of the tetraacetylethylenediamine used was as follows (in percent by weight):

1.6 mm–0.8 mm=1 percent
0.8 mm–0.1 mm=85 percent
0.1 mm–0.01 mm=9 percent
smaller than 0.01 mm=5 percent.

Subsequently, 0.629 parts by weight of sodium carboxymethyl cellulose in the form of a 3 percent aqueous solution were added over a period of 5 minutes through the rotating hollow drive shaft of the mixer, and the resulting mixture was then granulated for 1 more minute. After drying at a temperature of 60° C. to a moisture content of less then 1 percent by weight, and subsequent separation by screening of the fine and coarse grains with a particle size of less than 0.5 mm or more than 1.5 mm, 76 percent by weight of a homogenous, free-flowing granulate was obtained. This granulate when used in a washing machine together with a heavy duty detergent composition without foam inhibitor made it possible to conduct the washing process without excessive foam development.

EXAMPLE 5

The process as described in Example 4 was repeated, however, with the polysiloxane defoaming agent dispersed in the aqueous granulating liquid containing the carboxymethyl cellulose. The product thus obtained corresponded with respect to its properties to the product as obtained according to Example 4.

EXAMPLE 6

Forty-two kilograms of the powdered tetraacetylethylenediamine used in Example 1 and 2.24 kg of sodium carboxymethyl cellulose having the particle size given in Example 1 (88.2 percent of the total amount used) were mixed for 2 minutes in a drum mixer equipped with rotating mixing elements (LOEDIGE mixer) and then sprayed with a solution of 170.4 gm of sodium carboxymethyl cellulose in 5.51 kg of water (3 percent by weight) with continued mixing, to bind the dust-like particles.

The mixture was transferred into a continuous mixing granulator (output 800 kg/hr). The discharging chute of this mixer was connected to the feeder via conveyor belts, so that the product could be circulated. An amount of 4.3 kg of a 3 percent solution of sodium carboxymethyl cellulose (corresponding to 129 gm) was added through the rotating shaft of the granulating mixer over a period of 9 minutes.

Subsequently, 40 kg of anhydrous sodium tripolyphosphate (phase II content 92 percent by weight, diphosphate content 2 percent by weight) were added in the course of 3 minutes and the granulation process was allowed to continue for another 3 minutes. A dry, free flowing granulate was obtained having a content of 58 percent by weight of particle sizes between 0.5 and 1.5 mm. Coarse and fine particles were removed by screening and added to the next granulating process, after milling the coarse particles.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A process for preparing bleach activator granulates comprising from about 90 to 98 percent by weight of bleach activator and from about 10 to 2 percent by weight of granulating adjuvant, based on the weight of the anhydrous components, which consists essentially of the steps of:

(a) mixing for a time sufficient to form a homogeneous mixture powdered bleach activator which has a mean particle size of from about 0.01 to 0.8 mm with from about 50 to 100 percent by weight of the total granulating adjuvant to be used, which granulating adjuvant comprises a water-soluble cellulose ether, starch, or starch ether in the form of a free-flowing powder having a mean particle size of from about 0.01 to 0.8 mm;

(b) moistening the mixture from step (a) with water or an aqueous solution containing the remainder of the granulating adjuvant in a solution of from about 0.1 to 10 percent by weight, based on the weight of the total solution;

(c) granulating the moist mixture from step (b); and (d) drying the moist granulate from step (c) at an elevated temperature not exceeding 100° C. until the moisture content is less than 2 percent by weight.

2. The process of claim 1, wherein the bleach activator is selected from the group consisting of N-acylated amines, diamines, amides, glycolurils, and mixtures thereof.

3. The process of claim 2, wherein the bleach activator is tetraacetylethylenediamine.

4. The process of claim 1, wherein the bleach activator comprises 25 or less percent by weight of particles with a particle size of from 0.8 to 1.6 mm, 50 or more percent by weight of particles with a particle size of from 0.01 to 0.8 mm, and 25 or less percent by weight of particles with a particle size of less than 0.01 mm.

5. The process of claim 4, wherein 10 or less percent by weight of the particles have a particle size of from 0.8 to 1.6 mm.

6. The process of claim 4, wherein 80 or more percent by weight of the particles have a particle size of from 0.01 to 0.8 mm.

7. The process of claim 4, wherein 10 or less percent of the particles have a particle size less than 0.01 mm.

8. The process of claim 1, wherein the granulating adjuvant comprises 25 or less percent by weight of particles with a particle size of from 0.8 to 1.6 mm, 50 or more percent by weight of particles with a particle size of from 0.01 to 0.8 mm, and 25 or less percent by weight of particles with a particles size of less than 0.01 mm.

9. The process of claim 8, wherein 10 or less percent by weight of the particles have a particle size of from 0.8 to 1.6 mm.

10. The process of claim 8, wherein 80 or more percent by weight of the particles have a particle size of from 0.01 to 0.8 mm.

11. The process of claim 8, wherein 10 or less percent of the particles have a particle size less than 0.01 mm.

12. The process of claim 1, wherein the granulating adjuvant is sodium carboxymethyl cellulose.

13. The process of claim 1, wherein from about 80 to 95 percent by weight of the total amount of granulating adjuvant is used in step (a).

14. The process of claim 1, wherein a from about 0.5 to 5 percent by weight aqueous solution of granulating adjuvant is used in step (b).

15. The process of claim 1, wherein the water content of the moist granulate is adjusted to from about 10 to 35 percent by weight in step (c).

16. The process of claim 15, wherein the water content is from about 15 to 25 percent by weight.

17. The process of claim 1, wherein the mixture of powders in step (a) is moistened with a portion of aqueous solution of granulating adjuvant, the mixing is continued for a while, and then the mixture is transferred to a granulator where the remainder of the aqueous solution of granulating adjuvant is added.

18. The process of claim 1, wherein a dye or color pigment is mixed into the powdered mixture of step (a) or the aqueous solution of granulating adjuvant of step (b).

19. The process of claim 1, wherein from about 0.01 to 1 percent by weight of dye or color pigment, based on the weight of the final product, is added.

20. The process of claims 1, 2, 3, 4, 8, 12, 14, 15, 17, 18, or 19, wherein in step (d) the moist granulate from step (c) is dried to a moisture content of less than 1 percent by weight.

21. The process of claim 1 which consists essentially of the steps of:

(a) mixing for a time sufficient to form a homogeneous mixture tetraacetylethylenediamine which has a mean particle size of from about 0.01 to 0.8 mm with from about 80 to 95 percent by weight of the total amount of granulating adjuvant to be used, said granulating adjuvant comprising sodium carboxymethyl cellulose having a mean particle size of from about 0.01 to 0.8 mm;

(b) moistening the mixture from step (a) with an aqueous solution comprising from about 0.5 to 5 percent by weight, based on the weight of the total solution, of the remainder of the sodium carboxymethyl cellulose;

(c) granulating the moist mixture from step (b), the water content being adjusted to from about 10 to 35 percent by weight; and (d) drying the moist granulate from step (c) at an elevated temperature not exceeding 100° C. until the moisture content is less than 1 percent by weight.

22. A bleach activator granulate prepared according to the process of claim 1.

23. A process of activating an aqueous solution of percompounds selected from the group consisting of hydrogen peroxide and water-soluble peroxyhydrates containing from 5 to 500 mg of active oxygen per liter of solution, which comprises incorporating into said solution a bleach activator granulate of claim 22.

24. The process of claim 1, wherein the moist granulate from step (c) is admixed with at least one anhydrous salt or one salt with low water content, this salt being able to bind the water moisture as water of crystallization.

25. The process of claim 24, wherein sodium tripolyphosphate is used, the weight ratio of tripolyphosphate to moist granulate being between 1:3 and 1:1.

26. The process of claim 25, wherein the weight ratio of tripolyphosphate to moist granulate is from 1:2 to 1:1.

27. The process of claim 1, wherein during step (a) or during step (b) a defoaming agent is added in an amount of from 1 to 5 percent by weight with respect to the finished granulate.

28. The process of claim 27, wherein polysiloxanes as well as their mixture with micro-sized silica are used as defoaming agent.

29. A foam-inhibiting bleach activator granulate prepared according to the process of claims 27 or 28.

30. A process of activating an aqueous solution of percompounds selected from the group consisting of hydrogen peroxide and water-soluble peroxyhydrates containing from 5 to 500 mg of active oxygen per liter of solution, which comprises incorporating into said solution a foam-inhibiting bleach activator granulate of claim 29.

* * * * *